United States Patent [19]

van Eyken

[11] 4,356,773

[45] Nov. 2, 1982

[54] HYDRAULICALLY DRIVEN RAILWAY CAR

[75] Inventor: Lawrence A. J. van Eyken, Kingston, Canada

[73] Assignee: Queen's University at Kingston, Kingston, Canada

[21] Appl. No.: 83,216

[22] Filed: Oct. 9, 1979

[30] Foreign Application Priority Data

Oct. 17, 1978 [CA] Canada ..... 313552

[51] Int. Cl.[3] ..... B61C 9/14; B61C 13/00; B61D 15/12

[52] U.S. Cl. ..... 105/26.1; 105/27; 105/64 R; 105/96.2; 105/162; 105/456; 180/308

[58] Field of Search ..... 105/26 R, 26.1, 27, 105/63, 64 R, 90 R, 96.2, 177, 456, 162; 180/307, 308

[56] References Cited

U.S. PATENT DOCUMENTS

| | | | |
|---|---|---|---|
| 732,908 | 7/1903 | Thompson | 105/64 R X |
| 1,333,012 | 3/1920 | De Puydt et al. | 105/64 R X |
| 1,417,716 | 5/1922 | Cartlidge | 105/64 R |
| 1,456,659 | 5/1923 | Vanatta | 105/162 |
| 1,537,642 | 5/1925 | Laffey | 105/64 R |
| 1,606,471 | 11/1926 | Kastler | 105/162 |
| 1,679,544 | 8/1928 | Robson | 105/63 X |
| 2,057,230 | 10/1936 | Callison et al. | 105/26.1 |
| 2,158,352 | 5/1939 | Brown | 105/177 |
| 2,566,178 | 8/1951 | Eustis et al. | 105/456 |
| 3,154,164 | 10/1964 | Shaw et al. | 180/308 X |
| 3,256,950 | 6/1966 | Di Biasi | 180/307 X |
| 3,912,033 | 10/1975 | Ancel | 180/307 X |
| 4,167,142 | 9/1979 | Ames | 105/26 R |

FOREIGN PATENT DOCUMENTS

| | | | |
|---|---|---|---|
| 218692 | 5/1922 | Canada | 105/162 |
| 911811 | 10/1972 | Canada | 105/26 R |
| 1296877 | 11/1972 | United Kingdom | 105/26 R |

*Primary Examiner*—Robert B. Reeves
*Assistant Examiner*—Howard Beltran
*Attorney, Agent, or Firm*—Stanley E. Johnson; Richard J. Hicks

[57] ABSTRACT

A motorized track car with a wheeled lower portion for rolling along a railroad track, and a platform carried by the wheeled lower portion. The platform has seating accommodation for one or more persons with the propulsion means for the vehicle disposed below the platform. The propulsion means consists of an internal combustion engine drivingly connected to hydraulic pump means providing fluid pressure for hydraulic motors drivingly associated with wheels of the car. There is control valve means operable by a person seated on the platform to control flow of hydraulic fluid for the pump and motor to vary the speed of travel of the vehicle from zero to maximum in each of forward and backward directions of travel. There is brake means operatively associated with at least one wheel of the track car and operable from the platform and, preferably, by a single lever control which also operates the control valve means. The arrangement of the propulsion means and seating accommodation is such as to provide a compact vehicle with maximum accommodation for a pay load and a vehicle weight such that it can be manually removed from and placed on the track by no more than two persons.

14 Claims, 10 Drawing Figures 40
42
41
25
31
30
54
24
53
55
26
29
36
28
27
90
33
91
13
7
34
7
23
13
34C
22
38
32
37
35
39

HYDRAULICALLY DRIVEN RAILWAY CAR

This invention relates to a track motor car suitable for service on railways, such as for example, a "section gang motor car".

Railway companies use track vehicles of this nature extensively for rail inspection service and transporting track maintenance personnel, tools, and equipment. The presently used track motor cars have undergone relatively few, if any, changes in design for many years and those presently on the market are propelled by an internal combustion engine through a drive train having a mechanical transmission. The transmission and drive train occupies most of the large central trunking which runs along the length of the car leaving little space for the storage of tools or seating accommodation for the occupants. Also, levers, necessary to operate and control the engine and transmission, occupy a large portion of the space on the surface on the trunking which otherwise could be available for seating accommodation.

It would be possible to reduce the number of controls and provide more room for passengers by use of an automatic two speed gear box, and which would combine the functions of clutch and gear train mechanisms automatically and dispense with two levers. At the same time, it would require less expertise on the part of the operator and make the transmission relatively impervious to abuse. This, however, is considered unsatisfactory for several reasons. Firstly, a mere reduction in the number of levers doesn't materially increase the seating accommodation. Secondly, reasonably priced gear boxes suitable for the purpose are subject to high wear rates under certain driving conditions. Thirdly, the cost of the system is prohibitive and difficult to maintain.

Through the use of vehicles of this nature, railroad companies have established certain specifications for a section gang motor car. Some of the major specifications established by the Canadian Pacific Railroad Company are as follows:

(a) Capacity: Capable of accommodating six men seated with feet on a firm platform and within reach of sturdy hand holds and also secure accommodation for tools and equipment of up to 400 lbs.

(b) Speed and Hauling: A vehicle capable of carrying the full pay load maintaining a speed of 30 miles per hour on a level track against a 20 mile per hour head wind. A vehicle capable of pulling a loaded push car having a gross weight of 2 tons at 15 miles per hour on level track.

(c) Cab and Fittings: Seating accommodation arranged such that all six persons can disembark in 7 seconds from command to do so and having full visibility front, rear and 90 degrees both sides of front.

(d) Engine and Drive: A propulsion system capable of operating in ambient temperatures having a range of from about 43° C. to about −45° C. and a transmission uneffected by snow.

(e) Weight: The vehicle has to be of the size and weight capable of being detracked by no more than two persons in the case of a section gang car, and one person in the case of an inspection motor car capable of accommodating four persons.

The principal object of the present invention, is to provide a track motor car designed to fulfill the user's requirements and one which overcomes the disadvantages and difficulties of the existingly used track motor cars.

In accordance with the present invention, there is provided a track motor car that has a drive system which incorporates a hydrostatic transmission providing a vehicle which is compact but at the same time has maximized utilization of the space thereof for a pay load.

The hydrostatic transmission consists basically of a variable capacity over-centre control, hydrostatic pump driven by an air-cooled gasoline engine governed at constant rpm by an adjustable-speed governor.

The pump delivers hydraulic fluid to two hydrostatic motors (essentially pumps acting in reverse) which are connected in parallel in a closed hydraulic system. The discharge from the motors is ducted directly back to the pump inlet point. This arrangement of motors provides inherent differential action exactly the same as would be provided by a mechanical differential system.

Since the connections between pump and motors may be a combination of high pressure tubes and hoses which may easily be routed around obstructions or right corners, a great deal of flexibility is afforded in locating the engine and pump system. The pump may be close-coupled to the motors, or remotely placed in any convenient location.

The over-centre pump capacity control is such that the displacement of a lever on the pump casing through an angle of approximately 18° either side of centre will cause the pump to change its delivery rate from full capacity in one direction—through zero flow—to full capacity flow in the reverse direction. This maneuver can be carried out without change in speed or sense of the pump drive shaft revolutions. This means that the direction of rotation of the pump drive shaft does not have to be reversed in order to reverse the direction of the drive.

The system provides the same characteristics of an infinitely variable positive drive gearbox in both forward and reverse directions. The gear ratio between engine and motor output shaft is merely a function of the ratio of pump capacity to motor capacity.

At zero capacity setting on the pump control, the gear ratio of the transmission is infinite. Practically, this means that the pump delivers no fluid in either direction, irrespective of engine revolutions, and the engine is effectively "declutched" from the transmission. Thus, at this setting of the controls, the engine may be started at zero load. It is a unique feature of this type of closed circuit hydrostatic system, that when the pump is at zero capacity the hydrostatic motors are hydraulically locked while at the same time the engine is declutched. Thus, in addition to the function of variable gearbox, reverse gear and clutch, the function of a brake is added. All may be controlled by a single lever. In fact, the dynamic braking capability is inherent in the system at all settings of the control.

The flexibility of the hydrostatic transmission, with the adaptability of its components and controls both as to performance and disposition thus provide a vehicle that is compact and still fulfills the demanding service and user requirements.

The brake systems used on current track motor car are of the toggle-type. In this system, wooden brake blocks are applied to the wheels through a mechanical linkage. Again, this system leaves little choice as to the location of the brake lever, which must inevitably be placed in a position least suited to the convenience of passengers or efficiency of storage. In the present vehicle, disc brakes are used which are hydraulically operated from a central hydraulic cylinder, also controlled by the pump capacity control lever.

Accordingly, in keeping with the foregoing, there is provided particularly in accordance with the present invention, a motorized track car comprising a wheeled lower portion for rolling along a railroad track; a platform carried by said wheeled lower portion and having seat means thereon for accommodating one or more persons, said seat means being arranged for maximized useage of the area of the platform, propulsion means for said track car disposed below said platform and comprising a combustion engine, hydraulic pump means drivingly connected to said engine, and hydraulic motor means drivingly associated with at least one wheel of the car; control valve means operable by a person seated on the platform to control flow of hydraulic fluid for said pump and motor means to vary the speed of travel of the vehicle from zero to maximum in each of forward and backward direction of travel, and brake means operatively associated with at least one wheel of the track car, said propulsion means providing a vehicle that is compact but at the same time providing maximum accommodation for a pay load and with a vehicle weight such that it can be manually removed from and placed on the track by no more than two persons.

The invention is illustrated by way of example, with reference to the accompanying drawings, wherein.

Figure 1:
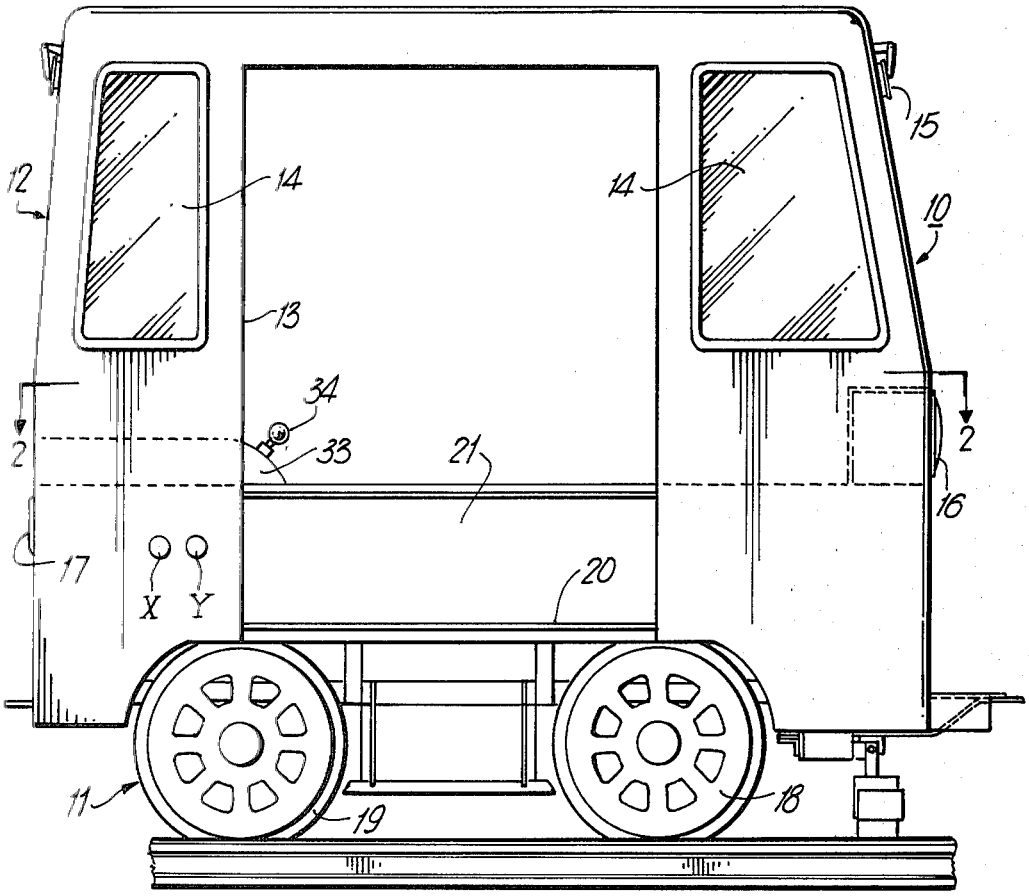
FIG. 1 is a side elevational view of the track motor car provided in accordance with the present invention.
Figure 6:
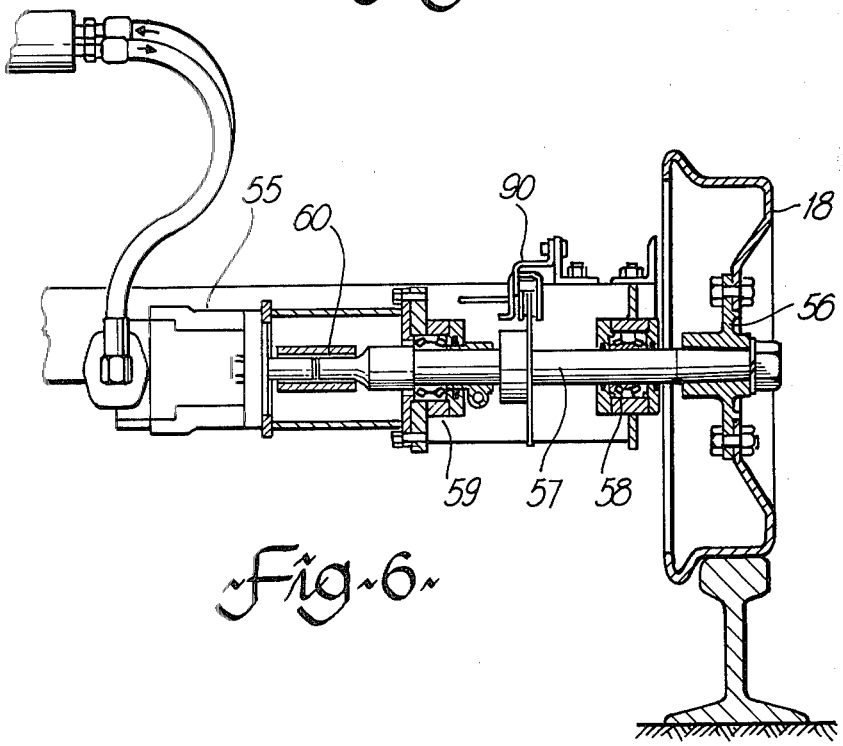
FIG. 6 is a partial sectional elevational view of the drive of one of the wheels of the track motor car.

Referring now to the drawings, there is illustrated in FIG. 1 a track motor car 10 having a wheeled lower frame portion 11 on which there is mounted a cab 12. The cab 12 has openings 13 on each of opposite sides thereof for ingress and egress of the occupants utilizing the motor car. The opposite side walls are also provided with windows 14 providing side visibility, and similarly front and rear walls are provided with windows for visibility to the front and rear of the car. The front and rear windows are provided with electrically driven wipers 15 and running lights 16 are mounted in the front wall and tail lights 17 in the rear wall. Each of the front and rear walls may be provided with running lights and tail lights since, as will be seen hereinafter, the motor car is driveable with substantially equal performance in either the forward or rearward direction. This eliminates the need to turn the motor car on the track to and from the maintenance site as has been the case with previously known motor cars provided for this purpose.

The wheeled lower portion 11 has respective front and rear pairs of wheels 18 and 19 adapted to run along a railroad track. The front and rear wheel assembly are interconnected by a frame consisting of a weldment of members (or alternatively, a unitized cab and frame) and on the upper side of which there is a platform 20. The platform overlies the propulsion system for the vehicle and is arranged with compartments therein and seats thereon for accommodating tools and equipment to be carried by the motor car as well as the operator for the motor car and other passengers.

Figure 2:
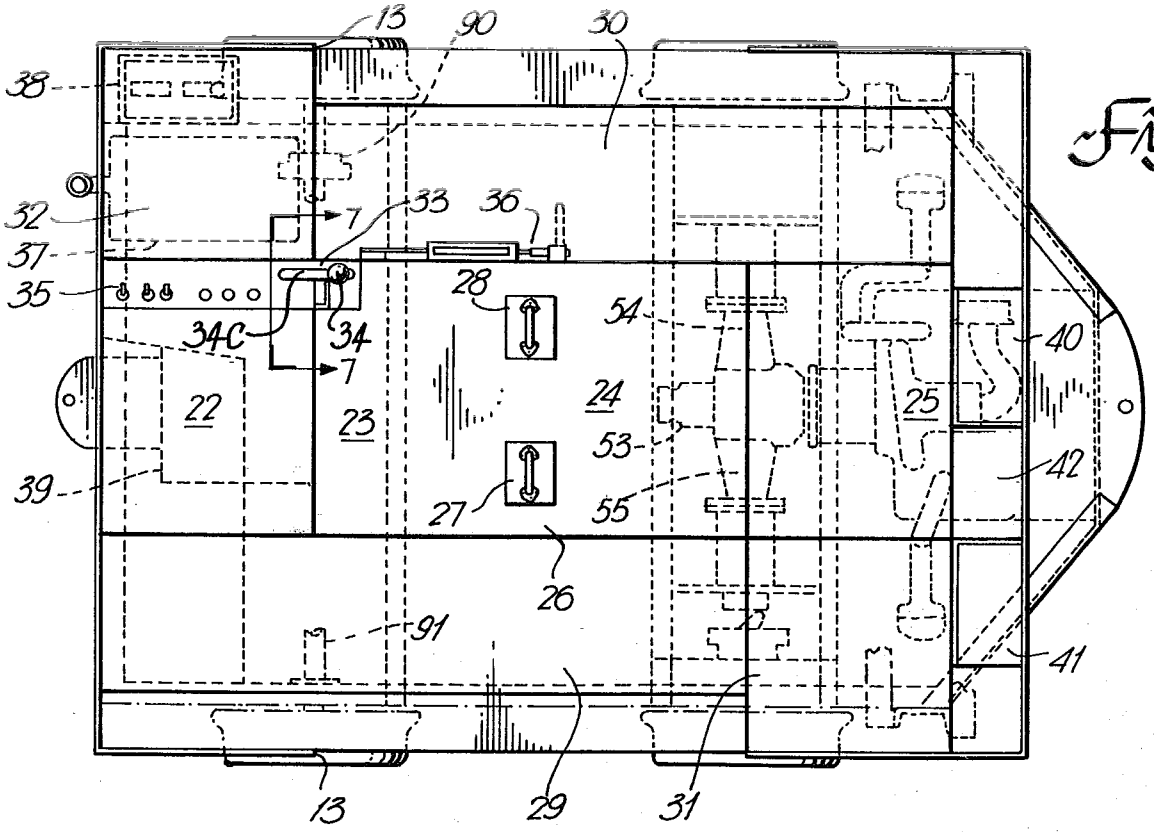
FIG. 2 is a top plan view taken essentially along line 2—2 of FIG. 1 but with parts broken away or removed for purposes of clarity.
Figure 4:
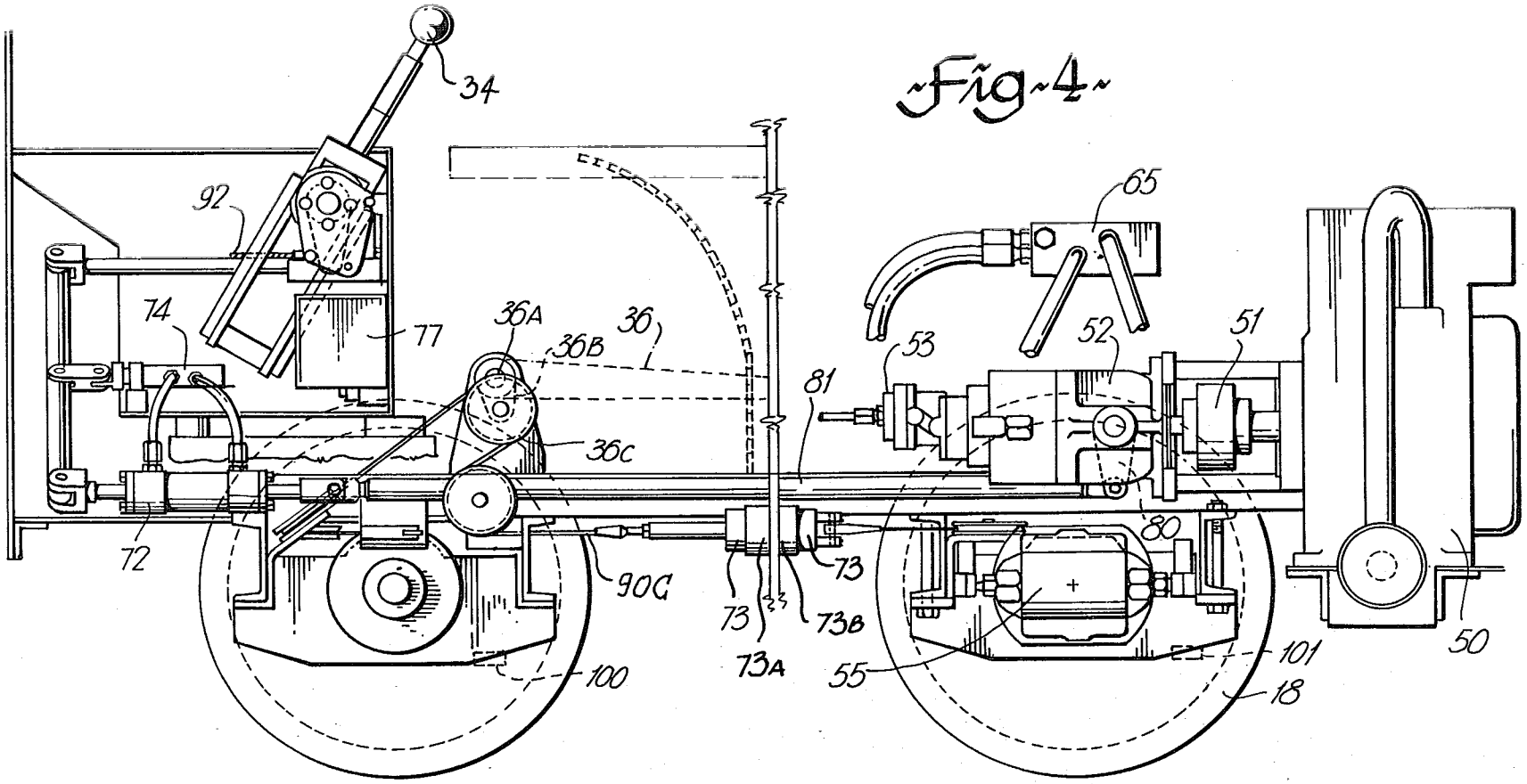
FIG. 4 is a partial elevational view of the motor car with parts removed, illustrating the propulsion and braking mechanism and controls therefor.
Figure 8:
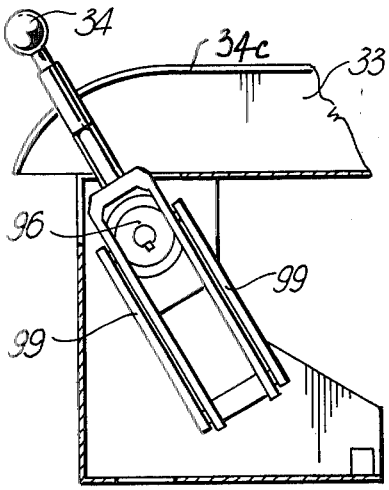
FIG. 8 is a sectional view taken along line 8—8 of FIG. 7.
Figure 7:
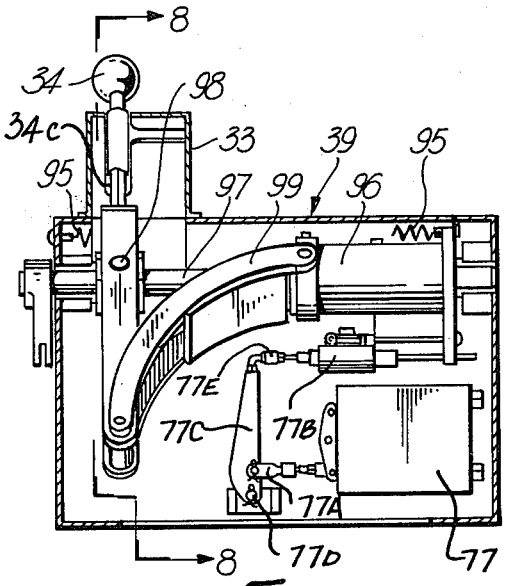
FIG. 7 is a partial sectional elevational view taken essentially along lines 7—7 of FIG. 2 showing details of the single lever control for the propulsion and braking system of the track motor car.

From FIGS. 1 and 2 it will be seen the platform is provided with a central raised portion 21 extending longitudinally of the vehicle and narrower than the width of the vehicle. This raised portion provides seating for passengers at each of the positions designated 22, 23, 24 and 25. The seating positions 23, and 24 are provided by a removeable cover 26 on the upper raised portion of the platform, and below which cover there is a compartment for accommodating tools and other equipment. The removeable cover 26 is provided with sunken hand holds 27 28 to facilitate removal of the cover for access to the compartment. The platform on opposite sides of the central raised portion has floor portions respectively 29 and 30 and which may be metal, wood, fiberglass, or a combination thereof. Further occupant seats 31 and 32 are provided at the end of respective floors 29 and 30, seat 32 being the driver's seat and located adjacent a console 33 that projects upwardly from the platform raised portion 21. The console 33 has a single lever control 34 for operating the propulsion system to travel both in forward and reverse and also operates the braking system in a manner that will be described in detail hereinafter. Mounted on the console are also switches 35 and other control devices and/or indicators, gauges and the like necessary for operating the vehicle. A hand operable emergency brake lever 36 is mounted on one side of the upwardly projecting platform portion 21, adjacent the driver's seat and control console. Below the driver's seat 32 there is located a fuel storage tank 37 and a storage battery 38 for the electrical system. A control box assembly 39 is located below the passenger's seat 22. Details of such control box are shown in FIGS. 4, 7 and 8 and which will be described in detail hereinafter.

The cab is provided with further storage compartments 40 and 41 respectively on opposite sides of a platform 42 for a transceiver at the forward end of the vehicle.

From the foregoing, it can be seen that the platform is arranged for maximum storage and seating accommodation in a minimum area with ready access to the cab for the occupants to quickly disembark upon command to do so.

The cab 12 can be dispensed with, if so desired, should one wish to have an open vehicle and, as previously mentioned, the cab, floor and frame for the wheeled assembly may be a unitized body and frame made of metal, wood, fibreglass or combinations thereof.

Figure 5:
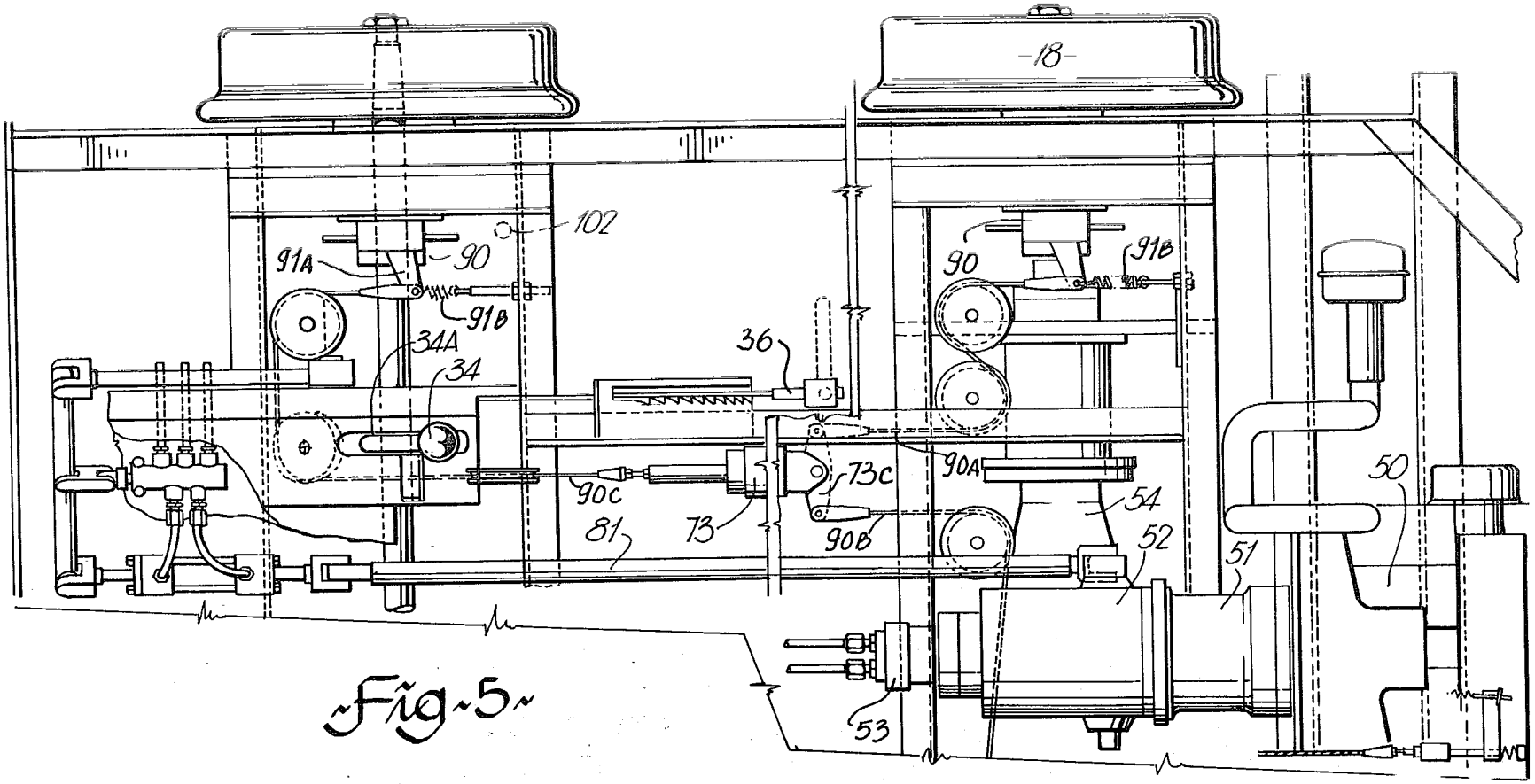
FIG. 5 is a top plan view of FIG. 4.

The propulsion and braking system for the vehicle is disposed below the platform 20 and is a hydraulic system which permits considerable versatility in locating the various components, and at the same time is compact, maximizing utilization of the vehicle for carrying a pay load of occupants and equipment. The arrangement of components and various details of the propulsion and braking system are clearly shown in FIGS. 2, 4 and 5, FIG. 4 being an elevational view of the lower part of the vehicle minus the cab seating assembly, and FIG. 5 a plan view of FIG. 4 to the center line of the car. The main components of the system; i.e. engine, pump and motor assemblies are symmetrical about the center line of the vehicle.

Referring now to these drawings, there is illustrated an air-cooled internal combustion engine 50 mounted on the frame and drivingly connected by way of a coupling 51 to an hydraulic pump 52. Coupling 51 can be replaced by using male and female splined shafts respectively on the engine and pump in which case the pump is mounted on the engine and coupled thereto in drive relation. By way of example, the engine is preferably a 25 bhp "Onan" air cooled gasoline engine running at a speed of 3,600 r.p.m. while the car is in motion and a lesser idling speed when the car is stationary, and a pump suitably matched to this engine is a "sundstrand" series 18 hydrostatic variable capacity pump. An auxiliary "piggy back" pump 53, for a servo and brake duty, is mounted on the pump 52 and one suitable for the purpose, by way of example, is a John S. Barnes Corporation, GC Series Code E pump.

The pair of front wheels 18 are driven by respective ones of the pair of hydraulic motors 54, and 55, each of which by way of example can be a Sundstrand Series 18 fixed capacity motor. The wheels are all the rimmed type detachably mounted on a hub 56, which in turn are detachably mounted on a shaft 57 journalled for rotation on the frame of the vehicle by respective ones of a pair of spaced apart bearings 58 and 59. The shaft 57 of the respective ones of the front pair of wheels 18 are driven by the motors 54, 55 by way of respective ones of a pair of muff couplings 60.

The pump 52, together with its boost pump and auxiliary piggyback pump 53, are driven by the gasoline internal combustion engine 50 and the main pump 52 delivers pressurized fluid to the two identical motors 54 and 55, which are connected in parallel to the pump output. The discharge from the motors is fed directly back to the pump inlet, or alternatively, via an oil cooler (not shown) which if desired may be used to heat the cab of the vehicle. The boost pump, identified in FIG. 9 by the reference number 61 draws hydraulic fluid from the small reservoir 62 and automatically boosts the suction side of the main pump to approximately 100 p.s.i. by either of a pair of check valves 63, depending on whether the pump is delivering in the forward sense or the reverse. This effectively prevents the damaging effects of cavitation at the pump inlet and makes up what ever leakage loss there may be in the system. The surplus from the boost pump returns to the reservoir by way of relief valve 64.

Figure 9:
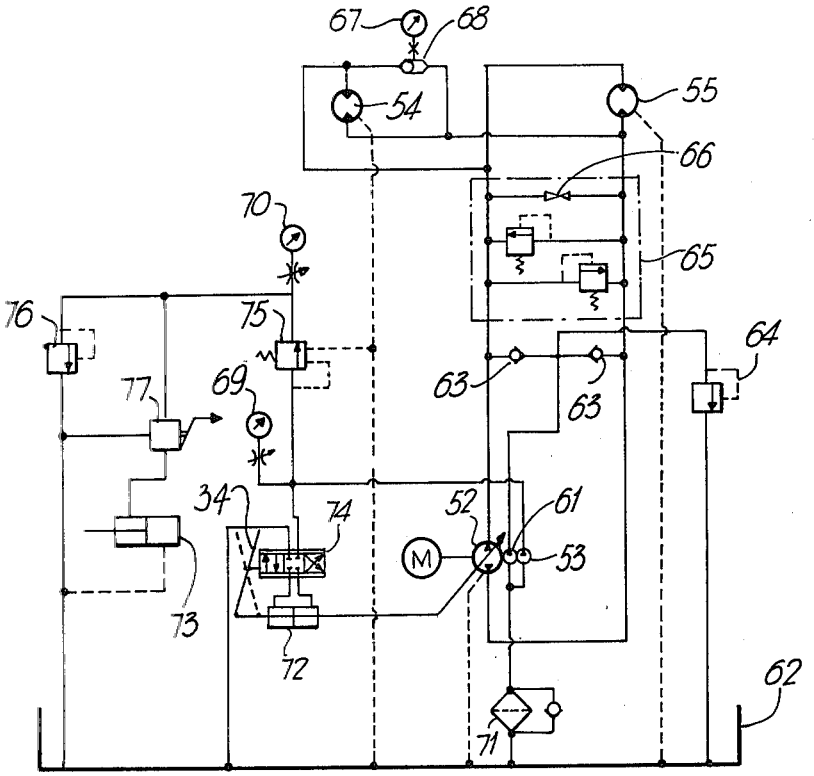
FIG. 9 is a hydraulic flow diagram of the propulsion and braking system.

The delivery pressure of hydraulic fluid to the hydrostatic motors 54 and 55 is controlled by cross-over dual relief valves in a manifold shown enclosed by dotted line 65 in FIG. 9. These valves will by-pass fluid from the high pressure side to the low pressure side of the system if the relief valve pressure setting is exceeded. Also shown in the manifold, is a by-pass valve 66 which can be opened for man-handling the car. When this valve is open both motors are short circuited and the car may free wheel.

The hydraulic system includes pressure gauges located at some convenient point for viewing; for example, on the console and in FIG. 9 there is shown gauge 67 which indicates the pressure in the high pressure side of the main transmission system, this being by way of shuttle valve 68. Two further gauges 69 and 70 indicate respectively servo pressure and hydraulic brake pressure.

The hydraulic system is protected by a 25 micron filter 71 in the common suction to respectively the boost pump 61 and the auxiliary pump 53.

A secondary hydraulic circuit serves a pump capacity control servo 72 and a hydraulic brake master cylinder 73. The oil supply for this is provided by the auxiliary "piggyback" pump 53. Oil from pump 53 is directed to a spool valve 74 which in turns directs fluid to either side of servo cylinder 72 in accordance with the sense of movement of the manual control lever 34. This controls the capacity of the main pump 52, and also the direction of flow through this pump. A sequence valve 75, set at 130 psi, gives priority of supply to the servo control. Downstream of the sequence valve, the pressure is controlled by a relief valve 76, set at 150 psi. This determines the pressure of supply to the brake control valve 77.

The brake control valve, 77, is an open-centre valve which normally permits uninterrupted flow back to the reservoir. When the brake valve is operated by the driver, the return path to the tank is obstructed so that the pressure in the supply line is raised by an amount proportional to valve movement. This rise in pressure is experienced by the hydraulic brake master cylinder, 73, which in turn applies a corresponding effort to disc brakes acting on all four wheels in a manner to be described hereinafter.

The disposition of the main pump 52, piggyback pump 53 and hydrostatic motors 54, 55; i.e. the main transmission elements, are positioned over the drive wheels at the front of the car. The manifold 65 containing the cross-over relief valves mentioned earlier and the distribution lines to the motors are positioned directly above the main pump as shown.

The main pump 52 capacity control lever 80 is connected by a push/pull rod 81 running along the bottom of the car to the servo cylinder 72 of which is controlled by the servo spool valve 74 in the manner shown. The arrangement employs inherent negative feedback for control of the position of the capacity control system.

The braking system is comprised of three mechanical caliper disc brakes 90, two of which are located on respective ones of the front wheel half-shafts 57, and one on the solid rear axle 91 serving the two rear wheels 19. The brakes are operated by the central hydraulic master cylinder 73 via cables and the linkage shown in FIG. 5. The master cylinder 73 is mounted on vehicle frame by a pair of brackets 73A and 73B which have aligned apertures to receive the cylinder. A sliding fit allows the cylinder to reciprocate upon extension and retraction of the piston cylinder unit equalizing braking forces applied to the front and rear brakes. The front brakes 90 are operated by respective ones of a pair of cables 90A and 90B connected to the cylinder via a balance arm 73C. The brake for the rear wheels is operated by a cable 90C connected at one end to the piston rod of the hydraulic master cylinder and at the other end to the lever 91A of the brake. The brake levers are also connected to tension return springs 91B. The linkage provides correct distribution of effort to the various brakes.

Control of the brake master cylinder is effected by the brake valve 77 located in the control assembly, via small diameter ($\frac{3}{8}''$) hydraulic tubing. Emergency braking is provided by the Emergency Brake Lever 36 located forward of the control consol 33 and near the floor of the car. The emergency brake lever operates by tensioning the brake cable. In this regard, lever 36 rotates on a shaft 36A and has affixed thereto an arm 36B on which there is journalled a pulley 36C. The cable 90C for the rear wheel brake passes around pulley 36C.

The gasoline engine 50, located at the front of the vehicle, is fitted with governor speed control. The governor is adjustable by means of a spring-loaded lever, connected remotely to the main control lever 34 by means of a shielded control cable 92. There are two settings of the governor—one for driving speed and one for idling and these settings occur automatically upon movement of the control lever 34 respectively to driving the braking positions.

The single lever control and brake valve are in a control box sub-assembly shown in detail in FIGS. 4, 7 and 8. The car is controlled through the single lever 34 operating in a guiding "tee" slot 34C in the console 33. In FIG. 8, the control lever 34 is shown in the intersection of the arms of the "tee" slot. However, if it were released from this position by the operator, it would be pulled into the "shank" of the "tee" by tension spring 95 attached to a sliding yoke 96. The yoke slides on a shaft 97 which is rotated by movement of the lever to and from reverse and forward position. The lever is pivoted as at 98 for slidably moving the yoke 96 via a connecting link 99. In this latter position the pump would be at zero capacity and the wheel motors would be hydraulically locked. The vehicle would thus be effectively braked even though the engine may not be running. The hydraulic brake valve 77 is operated by linkage members 77A and 77B connected at one end respectively to the valve 77 and slidably yoke 96, and at the other end to a lever 77C pivoted for movement about a pin 77D. Link 77B is connected to lever 77C by a ball joint 77E or some other suitable hinge connection.

Since the pump is at zero capacity, it is effectively declutched from the transmission and the engine may be started.

On start-up, the engine will wind up to idling speed, the auxiliary pump will supply servo fluid pressure and the disc brakes will be activated via the linkage to the brake control valve under the action of the tension spring. In order to release the brakes, the operator moves the lever to the left to the neutral position at the cross of the "tee" slot. This motion also sets the engine governor to the driving speed, via the governor control cable 92 also attached to the sliding yoke.

In order to set the vehicle in forward motion, the operator pushes the control lever forward. This increases the "stroke" of the pump via the pump servo. The speed of the car will depend on the degree of movement the operator gives to the lever.

To slow down the operator moves the lever back toward neutral and thereby retards the vehicle through the dynamic braking effect of the motors. In this mode the motors become pumps and the main pump becomes a motor. To come to a stand-still, the operator moves the lever first to neutral, thereby achieving full braking at the motors by virtue of the hydraulic locking effect, and then into the shank of the "tee" slot, thereby applying the disc brakes and reducing engine revolutions to idling speed.

Reverse motion of the car is achieved by moving out of the gate and pulling back on the control lever. Again braking is achieved in the same way as before, by first moving back to neutral and then into the shank of the "tee" slot.

There are a number of features of the control which are, as follows:

(1) Limiting stops on the control lever make it impossible for the operator to overload the engine. At the same time, it could be made impossible to stall the engine by limiting the speed of response of the pump servo control by means of throttling valves in the feed to the servo cylinder or over-decelerate or over-brake.

(2) The control lever can be moved to reverse while the vehicle is moving forward. This would have the effect of applying full braking torque to the driving wheels. Again the engine would not be overloaded and the hydraulic system would be protected from overpressurization by the relief valves.

(3) A "Dead Man's Handle" effect is built in by self-centering springs on the control lever (these are not shown on the drawing). If the operator releases the control lever for any reason, the lever will return to neutral and be pulled into the shank of the "tee" slot, thereby unloading the engine, returning engine to idling speed, and applying all bakes.

(4) Start-up of the engine would be inhibited by a suitable limit switch in the starter circuit (not shown in the drawing) unless the control lever is in the neutral position.

As an alternative to the dual motor drive described, one hydrostatic motor can be used to drive a common axis for two drive wheels.

In such instance, the single motor transmission drives a reduction gearbox mounted on the drive axle. The differential gear would, in this case, be replaced by a pair of undriven free wheels, as in the conventional car design.

With the single motor drive, a gearbox is considered necessary to magnify the torque of the motor. At the same time, the motor speed would be increased. This is quite within the capability of the Series 18 Sundstrand units.

It might be considered by some that the cost of a gearbox would be greater than the cost of an extra motor for the dual motor drive. However, the dual motor system requires bell housings, couplings and extra bearings for the half-shafts, together with a more complex plumbing system. The cost differential, however, between the two systems is minimal and one advantage of the single motor transmission involves less weight, less complexity, and a saving in space.

Track cars of the foregoing type used, for example, on track maintenance operations must frequently be removed from the tracks to prevent interrupting normal freight and passenger train service. To facilitate removal of the track cars from the tracks, the lower portion of the frame may be provided with transverse slide bars. With the track car of the present design, hydraulically raisable and lowerable slide bars may be readily mounted on the lower frame. In FIG. 4, a pair of such slide bars are shown in broken line and identified by respective reference numerals 100 and 101. Each of the slide bars is raised and lowered by a pair of hydraulic jacks 102 mounted on the frame of the car with fluid pressure therefor being provided by one of the engine driven hydraulic pumps.

The hydraulic motors (or motor) used to propel the vehicle are described as being drivingly connected to the wheel shafts which are journalled on the frame. However, further weight reduction and/or additional space and/or reduced costs can be realized by locating the hydraulic motors in the hubs of the wheels. Hub type hydraulic motors are well known and can be readily adapted for mounting the rim track wheels directly thereon.

The foregoing hydraulically driven track motor car may be used not only to transport maintenance personnel and equipment but also as a power source at the maintenance site. The motor driven hydraulic pumps can be used to power hydraulic maintenance tools such as jacks to shift and/or straighten rails, hammers, tampers, tie cutters, shears and the like. This can be done by a minor modification, for example, by diverting the pressurized fluid from the pump to a quick disconnect coupling outlet to which the external hydraulically operated tools are connected and providing a suitable line for return of the fluid to the system. Disconnect couplings X and Y, for the foregoing purpose, are illustrated in FIG. 1. Special hydraulically operated devices may also be readily designed and used for detracking the vehicle avoiding the manual task.

The vehicle shown and described is devoid of doors but these can be readily provided. The doors, for example, may be gull wing type, manually or hydraulically operated, they may be rolling slat type or a horizontal sliding track type.

Figure 3B:
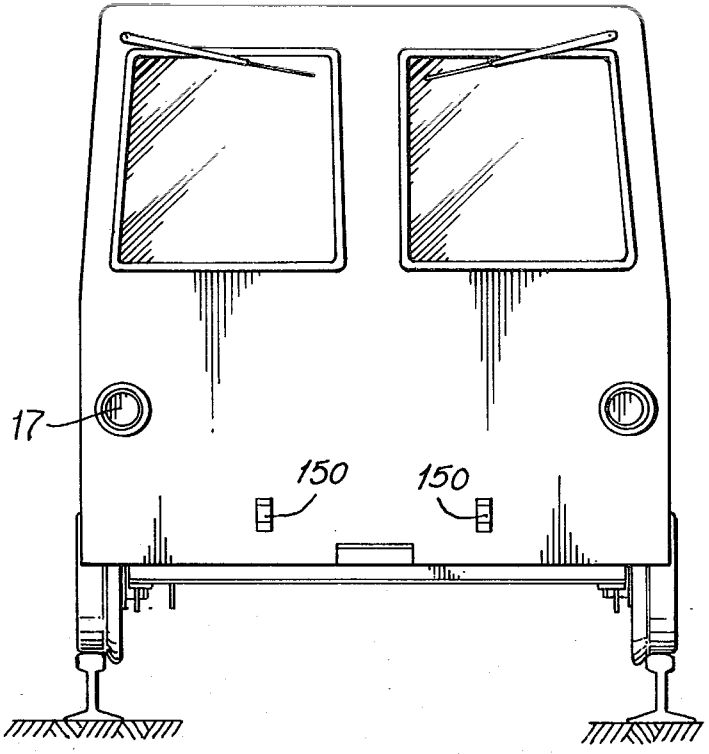
FIGS. 3A and 3B are respectively front and rear elevational views of the track motor car shown in FIG. 1.
Figure 3A:
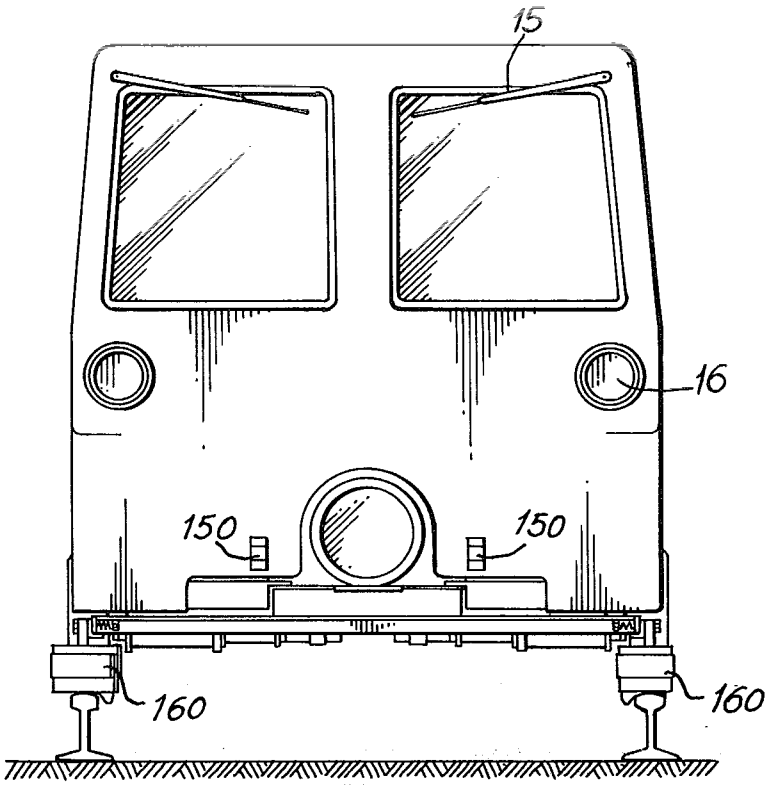

The vehicle is provided with a pair of retractable bars 150 to facilitate manually lifting the car during tracking and detracking. The bars 150 (see FIGS. 3A & 3B) extend full length of the car and are slidable in slots to project either beyond the front or rear wall of the cab. Alternatively, the bars may be telescopic for projecting beyond both the forward and rearward ends of the cab. Rail sweeps 160 are also provided to clear the running surface of the tracks when the vehicle is in motion.

The vehicle may be provided if so desired with other auxiliary hydraulically driven equipment because of the ease with which connections can be made to the power source. For example, a hydraulically powered snow blower and/or auger may be mounted at one or both ends of the vehicle. It will be obvious to those skilled in the art there is no limit to the variety of different pieces of auxiliary equipment that may be used within the capabilities of the power source. The simplicity of operation avoids the need of having a skilled operator as one need only push the single lever control in the direction one wishes to travel. Should the operator for any reason release the single lever control it automatically by spring bias returns to the braking position.

I claim:

1. A motorized track car comprising:

(a) a wheeled lower portion for rolling along a railroad track;

(b) a platform carried by said wheeled lower portion and having raised seat means thereon for accommodating at least one worker transported by the track car;

(c) hydraulic power means for propelling said track car and providing power for auxiliary equipment, said power means being located entirely below said platform and comprising a combustion engine, hydraulic pump means drivingly connected to said engine, and hydraulic motor means driven by said pump and drivingly associated with at least one wheel of the car;

(d) control valve means, actuated by a lever projecting upwardly from the platform, to control the capacity of the pump as well as the direction of fluid flow therethrough and thereby vary the speed of travel of the vehicle from zero to maximum in each of forward and backward directions of travel, said pump and motor being in a closed loop fluid flow system;

(e) brake means operatively associated with at least one wheel of the track car, and operable by said lever projecting upwardly from the platform, said car being compact light weight vehicle manually removable from and onto the track by no more than two workers while at the same time having maximized utilization of space for accommodating an operator, passengers and tools on the platform; and (f) means associated with said pump means for powering auxiliary hydraulic tools and equipment.

2. A motorized track car as defined in claim 1 including a cab over said platform.

3. A motorized track car as defined in claim 1 wherein said brake means is operatively associated with all of the wheels.

4. A motorized track car as defined in claim 1, including a pair of hydraulic motors drivingly associated with respective ones of two wheels of the car and connected to operate in parallel, said motors having fluid return lines connected to inlet means for said hydraulic pump means.

5. A motorized track car as defined in claim 1 including means resiliently biasing the single lever control to a brake-on position.

6. A motorized track car as defined in claim 1 including hydraulic fluid flow throttling valves limiting the rate of at least one of acceleration, deceleration and braking of the vehicle upon actuation of said manually operable control valve means.

7. A motorized track car as defined in claim 1 wherein a pair of hydraulic motors are drivingly associated with respective ones of a pair of wheels of the vehicle.

8. A motorized track car as defined in claim 1 wherein said seat means is provided by a raised portion on said platform and in which raised portion there is at least one storage compartment for tools, equipment and the like.

9. A motorized track car as defined in claim 8 wherein said platform raised portion extends longitudinally of the vehicle and has a width substantially less than the width of the platform and wherein at least a portion of the raised portion has seating accommodation provided by a removable cover that provides access to the storage compartments.

10. A motorized track car comprising:

(a) a lower frame portion having a pair of front wheels and a pair of rear wheels for rolling along a railroad track;

(b) a platform carried by said lower frame portion and having seat means thereon for accommodating at least four persons, said seat means being provided by a raised portion of the platform and which raised portion has compartments therein with access openings thereto for storing tools and equipment.

(c) propulsion means for said track car, disposed below said platform and, comprising a combustion engine, hydraulic pump means drivingly connected to said engine, and hydraulic motor means driven by said pump and drivingly associated with at least one wheel of the track car;

(d) control valve means to control the capacity of said pump and the direction of fluid flow therethrough thereby to vary the speed of travel of the vehicle from zero to maximum in each of forward and backward directions of travel, said pump and motor means being connected in a closed loop fluid flow path;

(e) brake means operatively associated with at least one wheel of the track car;

(f) single lever control means projecting upwardly from the platform for operating said control valve and located over said platform means and brake means; and (g) a cab carried by said car and located over said platform providing shelter for personnel transported by said track car, said cab having windows, running lights, and tail lights mounted thereon.

11. A track motor car as defined in claim 10 including at least one slide bar mounted on said frame by jack means permitting lowering the slide bar onto the railroad track facilitating removal of the car from the track in a direction transverse to the path of the track.

12. A motorized track car comprising:

(a) a lower frame portion having a pair of front wheels and a pair of rear wheels for rolling along a railroad track;

(b) a platform carried by said lower frame portion and having seat means provided by a central raised portion of the platform and in which raised portion there are compartments therein with access openings thereto for storing tools, equipment and the like;

(c) propulsion means for said track car, disposed entirely below said platform and comprising, a combustion engine, hydraulic pump means drivingly connected to said engine, and hydraulic motor means driven by said pump and drivingly associated with at least one wheel of the car;

(d) control valve means to control the capacity of said pump and the direction of fluid flow therethrough for the hydraulic motor means thereby to vary the speed of travel of the vehicle from zero to maximum in each of forward and backward directions of travel, said pump and motor means being in a closed loop fluid flow path;

(e) brake means operatively associated with at least one wheel of the track car;

(f) single lever control means projecting upwardly from the platform and movable from one position to another through a neutral position for respective forward and backward driving of the vehicle by operating said control valve means and movable laterally at the neutral position to operate said brake means; and (g) a cab carried by said car and located over said platform providing shelter for personnel transported by said track car, said cab having windows, running lights, and tail lights mounted thereon.

13. A motorized track car as defined in claim 12 including means resiliently biasing the single lever control to a brake on position.

14. A motorized track car comprising:

(a) a lower frame portion having a pair of front wheels and a pair of rear wheels for rolling along a railroad track;

(b) a platform carried by said lower frame portion and having seat means thereon for accommodating at least four persons, said seat means being provided by a raised central portion of the platform and extending longitudinally thereof and in which raised portion are located storage compartments with removable covers for access openings thereto;

(c) propulsion means for said track car disposed entirely below said platform, said propulsion means comprising a combustion engine, hydraulic pump means drivingly connected to said engine, and hydraulic motor means driven by said pump and drivingly associated with at least one wheel of the car;

(d) control valve means to control the capacity of said pump and the direction of fluid flow therethrough thereby to vary the speed of travel of the vehicle from zero to maximum in each of forward and backward directions of travel;

(e) brake means operatively associated with at least one wheel of the track car;

(f) single lever control means on said platform for operating said control valve means and brake means;

(g) means resiliently biasing said single lever control means to a brake on position; and (h) a cab carried by said car and located over said platform providing shelter for personnel transportrd by said track car and seated on said seat means, said cab having windows, running lights, and tail lights mounted thereon.

* * * * *